United States Patent [19]

Bergthaller et al.

[11] 4,386,155

[45] May 31, 1983

[54] PROCESS FOR THE PRODUCTION OF PHOTOGRAPHIC IMAGES

[75] Inventors: Peter Bergthaller, Cologne; Friedrich-Wilhelm Kunitz, Leverkusen; Karl-Wilhelm Schranz, Odenthal; Erich Wolff, Solingen, all of Fed. Rep. of Germany

[73] Assignee: Agfa-Gevaert AG, Leverkusen, Fed. Rep. of Germany

[21] Appl. No.: 298,999

[22] Filed: Sep. 3, 1981

[30] Foreign Application Priority Data

Sep. 9, 1980 [DE] Fed. Rep. of Germany ..... 3033861

[51] Int. Cl.[3] ..... G03C 7/00; G03C 5/38

[52] U.S. Cl. ..... 430/372; 430/376; 430/380

[58] Field of Search ..... 430/371, 372, 380, 376

[56] References Cited

U.S. PATENT DOCUMENTS

| | | | |
|---|---|---|---|
| 3,079,255 | 2/1963 | Wahl et al. | 430/380 |
| 3,342,599 | 9/1967 | Reeves | 430/380 |
| 3,762,922 | 10/1973 | Lugosy et al. | 430/380 |
| 4,271,253 | 6/1981 | Hara | 430/372 |

*Primary Examiner*—Mary F. Downey

*Attorney, Agent, or Firm*—Connolly and Hutz

[57] ABSTRACT

Colored images consisting of metal-complexed azomethine dyes are prepared by chromogenic development of silver halide photographic recording materials in the presence of color couplers. The color developers contain a grouping capable of metal chelate formation adjacent to the primary amino group. The azomethine dyes are transferred into the corresponding azomethine dye/metal complexes. The complex formation is accompanied by shift of color hue and increase of light stability.

3 Claims, 1 Drawing Figure

PROCESS FOR THE PRODUCTION OF PHOTOGRAPHIC IMAGES

Figure 1:
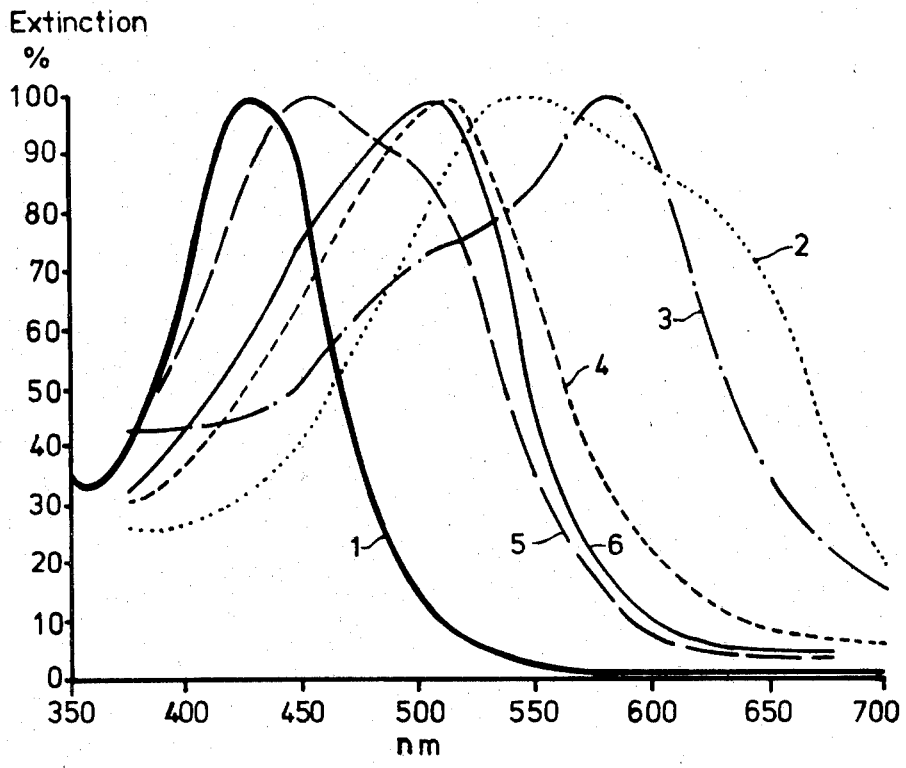

This invention relates to a process for the production of color photographic images in which azomethine dyes produced by chromogenic development are stabilized by complexing with metal salts. To this end, color developer compounds are used which contain a group capable of metal chelate formation adjacent to a primary amino group and the azomethine dyes produced during chromogenic development are converted into corresponding azomethine dye/metal complexes.

Color images are normally obtained by chromogenic development in which imagewise exposed silver halide emulsion layers are developed by means of suitable dye-forming developer substances, so-called "color developers," in the presence of suitable color couplers. The oxidation product of the color developer which is formed in consistency with the silver image reacts with the color coupler to form a dye image. The color developers normally used are aromatic compounds containing at least one primary amino group, particularly those of the p-phenylene diamine type which give azomethine dyes with the color couplers.

The color couplers used in color photographic recording materials are generally selected with the following considerations in mind:

During development, the couplers have to react as quickly as possible with the oxidation product of the color developer to form a dye. In other words, the couplers are required to have a very high color coupling velocity. In addition, the dyes formed during coupling reaction must have a required color and show high resistance to light, heat and moisture. Furthermore, the couplers must not impair the photographic properties of the photosensitive recording material by interacting with the silver halide present therein and other photographic additives, for example sensitizing dyes. Also, the couplers have to be stable in storage and inexpensive to produce.

Experience has shown that, compared with other classes of dyes, the azomethine dyes formed show lower stability to environmental influences, such as light, heat, moisture and oxygen, with the result that there has been no shortage of attempts in the past to use other classes of dyes.

Another possibility is subsequently to stabilize by complexing the class of azomethine dyes readily obtainable by oxidative coupling. Attempts in this direction have also been described in the literature. For example, imidazo[4,5-h] quinoline radicals have been introduced into yellow and magenta couplers for the purpose of stabilizing them in terms of resistance to diffusion and fastness to light. [Z. Chem. 15, (1975) No. 3, page 113; J. Signalaufzeichnungsmaterialien 4, (1976) pages 125–130; J. prakt. Chemie 317, 853 (1975)]. The effect on absorption of complexing and the stability of the complexed azomethine dyes was only minimal, presumably because the coordination site where the complex is formed is situated relatively far from the actual chromophore. In addition, the work involved in synthesizing compounds of the type in question is complicated from the preparative point of view.

An object of the present invention is to improve the stability of image dyes obtained by chromogenic development.

It has been found that the stability, particularly the fastness to light, of azomethine dyes may be improved by complexing with metals providing an additional coordination site, and hence the prerequisite for an increased complexing tendency, is created in the azomethine dye, particularly in the vicinity of the azomethine group formed by chromogenic development, by suitable substituents. This may be done by using color developers which contain a group capable of metal chelate formation adjacent to the primary amino group. During the treatment with metal salts, the azomethine dyes obtained with color developers of the type in question are converted into the corresponding azomethine dye/metal complexes.

Accordingly, the present invention relates to a process for the production of color photographic images by the chromogenic development of a recording material which has been image-wise exposed and which contains at least one silver halide emulsion layer, comprising the steps of:

(a) oxidizing a color developer compound containing a primary amino group and present in uniform distribution by silver halide which has been image-wise exposed; and (b) coupling the oxidized color developer compound with a color coupler present in uniform distribution to produce a dye image consisting of an azomethine dye; according to the invention the prerequisite for metal complexing of the chromogenically-developed azomethine dye is established by using a color developer compound which contains a grouping capable of metal chelate formation adjacent to the primary amino group and the chromogenically-developed azomethine dye is converted in the presence of metal ions into an azomethine dye/metal complex.

Accordingly, an important characteristic of the present invention is the use of specific color developer compounds. According to the present invention, these particular color developer compounds contain a grouping capable of metal chelate formation adjacent to a primary group, e.g. in the form of a ring nitrogen atom or in the form of a ring carbon atom carrying a substituent capable of metal chelate formation. During chromogenic development, this grouping capable of metal chelate formation moves into the vicinity of the azomethine group formed from the primary amino group, thereby evidently establishing a favourable prerequisite for subsequent complexing with metal ions. The intensive color shift observed is evidence of the participation of the chromophoric azomethine group in the complex forming reaction.

Color developer substances corresponding to the present invention may thus be represented by the general formula I below:

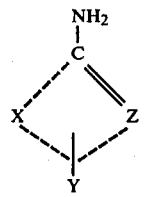

I wherein

X represents a radical which, together with C and Z, forms a 5- or 6-membered, carbocyclic or heterocyclic aromatic ring;

Y represents a substituent which, together with $NH_2$, imparts the properties of a color developer compound to the ring formed by C, X and Z; and Z represents a carbon atom, to which a group capable of metal chelate formation is attached, or a nitrogen atom.

Accordingly, in the color developer compounds used in accordance with the present invention, just as in the hitherto used color developer compounds, the primary amino group is attached to a carbon atom of a 5- or 6-membered carbocyclic or heterocyclic aromatic ring. In addition, the carbocyclic or heterocyclic ring completed by X in the general formula I is of such a nature and suitably substituted by Y and optionally other substitutents that a color developer compound is formed. The most well-known examples of color developer compounds of this type are those of the p-phenylene diamine type which derive from general formula I when the ring completed by X is a benzene ring and the substituent Y is a disubstituted (tertiary) amino group in the p-position to the primary amino group. In addition, a group capable of metal chelate formation situated adjacent to the primary amino group must of course also be present in accordance with the present invention. color developer compounds of this type are also known from the literature [for example J. Amer. Chem. Soc. 73, 3100 et seq (1971), compounds 20 and 27], but hitherto have only been studied for the effect of the substituents on the half-stage potential. Nothing was previously known of the complexing behaviour of developers of this type. Compounds corresponding to general formula I, wherein X completes a heterocyclic ring, for example a pyrazolone or isoxazolone ring, are described inter alia in German Pat. No. 1,002,627. These color developer compounds already contain, adjacent to the primary amino group, a group capable of metal chelate formation in the form of an (enolic) hydroxyl group and may therefore be directly used for the process according to the present invention. Further examples of color developer compounds according to the present invention having a heterocyclic ring completed by X are color developer compounds derived from 1,3-diazine.

Color developer compounds preferably used in accordance with the present invention correspond to general formula II below:

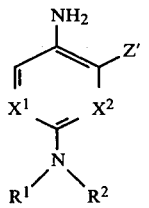

II wherein $X^1$ and $X^2$ each represents a nitrogen atom or a methine group;

Z' represents a group capable of metal chelate formation, for example —OH, —NH—$SO_2$—$CH_3$,

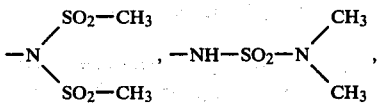

—$SO_2$—NH—R (R represents alkyl or aryl);

$R^1$ and $R^2$ represent alkyl, particularly containing from 1 to 4 carbon atoms, for example methyl, ethyl, n-propyl, isopropyl, and n-butyl, or substituted alkyl radicals, such as hydroxyethyl, ω-hydroxy butyl, ω-sulfobutyl or N-methane sulfonyl aminoethyl;

or $R^1$ and $R^2$ together represent the radical required to complete a cyclic amino group (for example pyrrolidino, piperidino or morpholino).

Examples of color developers which may be used in accordance with the present invention are given in the following:

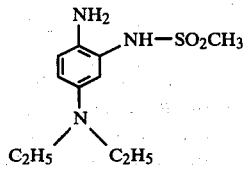

D-1

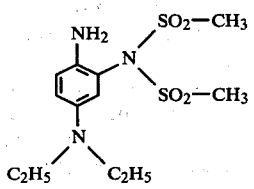

D-2

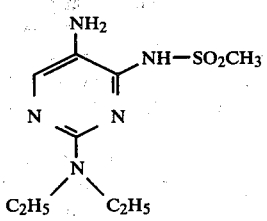

D-3

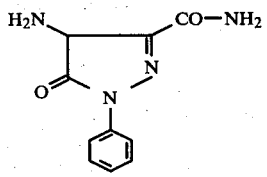

D-4

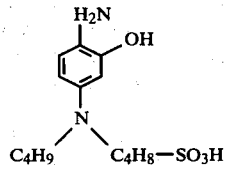

D-5

-continued

D-6

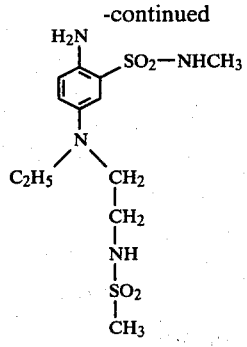

D-7

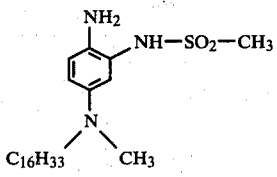

D-8

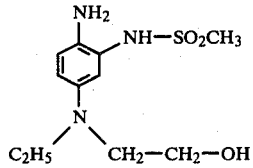

As observed above, the colour developer compounds used in accordance with the present invention contain a primary amino group. However, this does not mean that the primary amino group cannot be present in latent form only to being with. In other words, the primary amino group may be present in a masked form from which it is released during the actual chromogenic development process, possibly under the effect of alkali, and thus made available for the oxidative coupling reaction with the colour coupler. Colour developer precursor compounds containing a primary amino group present in latent form are known for example from British Pat. No. 783,887, U.S. Pat. No. 3,342,599 or German Auslegeschrift No. 1,007,171. Compounds of this type are particularly suitable for incorporation into colour photographic recording materials. To improve resistance to diffusion, the colour developer compounds may be provided with radicals which impart resistance to diffusion and which may be present either in the actual colour developer radical (for example in the form of a relatively long alkyl radical containing up to 18 carbon atoms for $R^1$ in formula II) or in the radical masking the primary amino group.

Virtually any known colour couplers which may be chromogenically developed with known colour developer substances may be used as colour couplers in the process according to the present invention. Colour couplers of a variety of different types may be considered (4-equivalent couplers, 2-equivalent couplers, DIR-couplers, masking couplers). The only requirement to be satisfied is that a chromophoric azomethine group should be formed during the chromogenic development process.

Examples of yellow couplers are given in the following:

Y-1

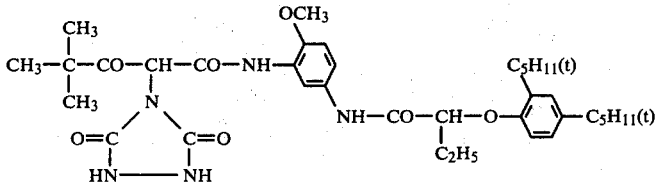

Y-2

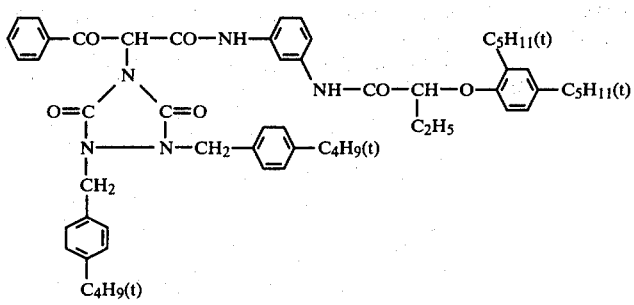

Y-3

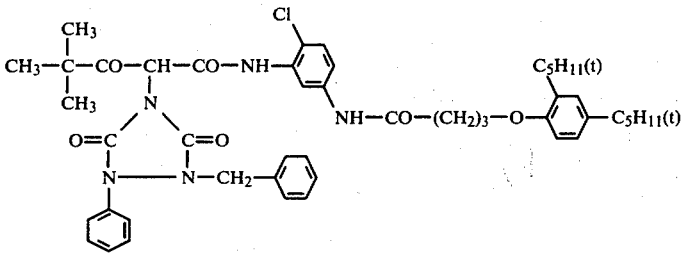

-continued
Y-4
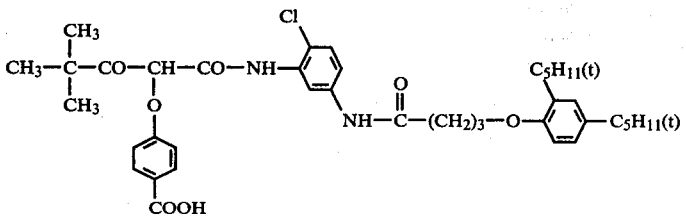
Y-5
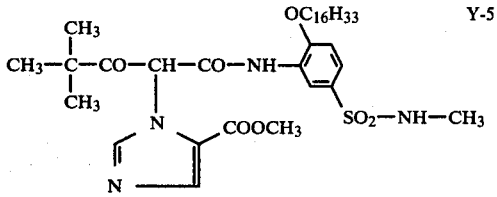
Y-6
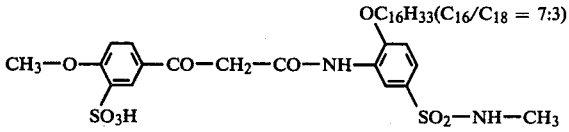
Y-7
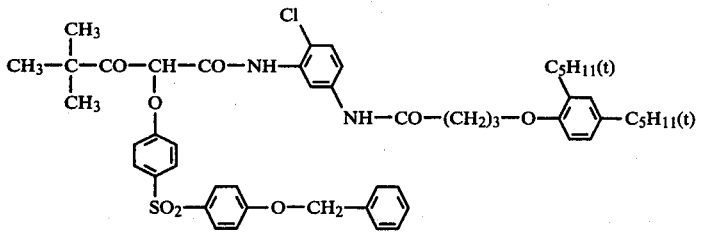
Y-8
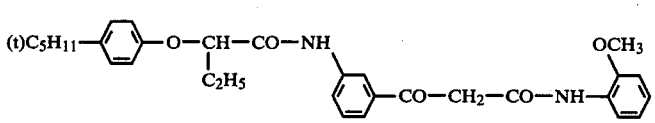
Y-9
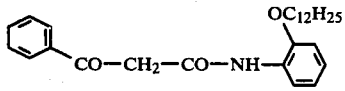
Y-10
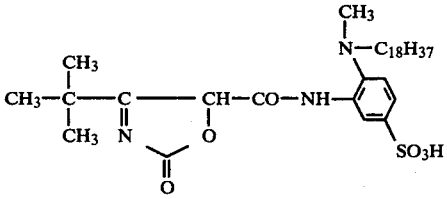
In the oxidative coupling reaction with the colour developers of structure D-1 to D-8 according to the present invention, yellow couplers give yellow to yellow-orange dyes.
Suitable magenta couplers having the following structures for example:
M-1
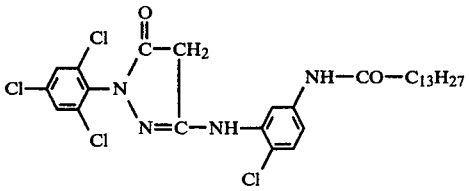
M-2
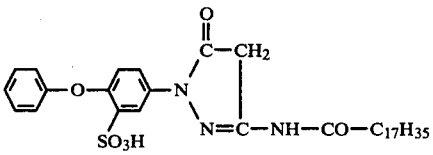
M-3
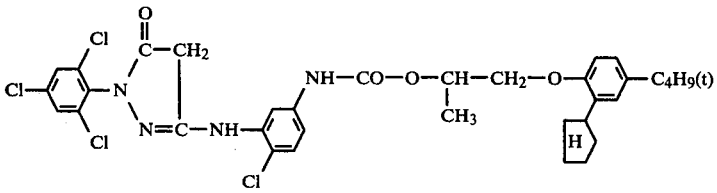

-continued
M-4
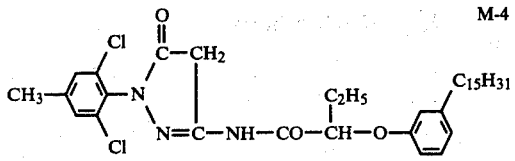
M-5
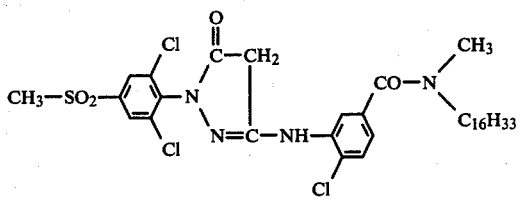
M-6
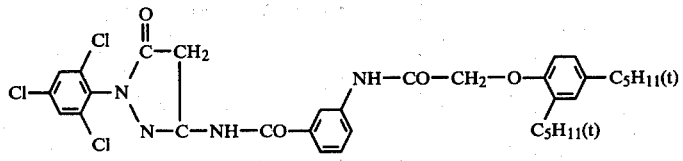
M-7
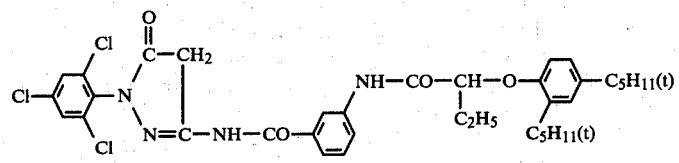
M-8
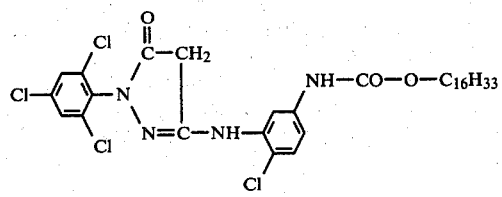
M-9
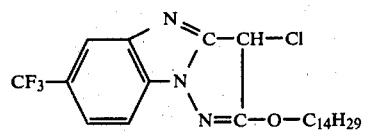
M-10
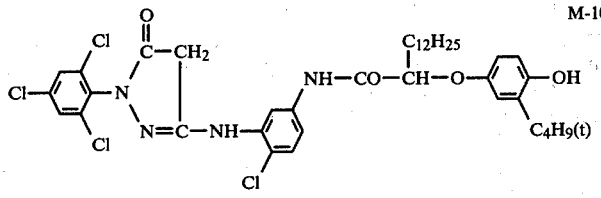
M-11
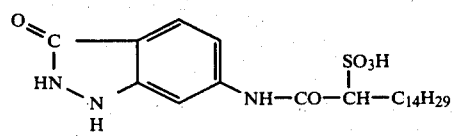
M-12
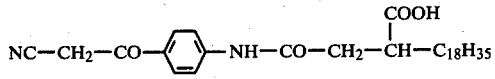
With the developers of structures D-1 to D-9 magenta couplers generally give red to magenta-red colours; M-11 gives grey and M-12 yellow dyes.
The following are typical examples of cyan couplers;
C-1
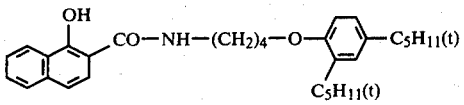
C-2
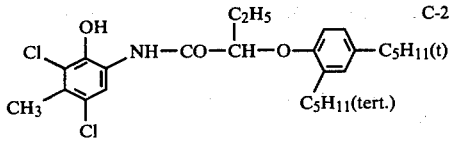
C-3
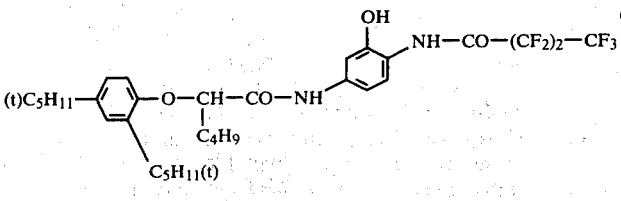
C-4
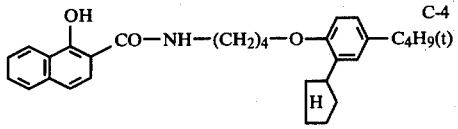

-continued

C-5

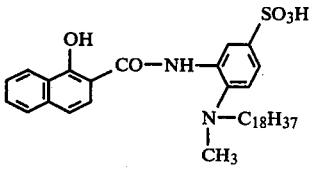

C-6

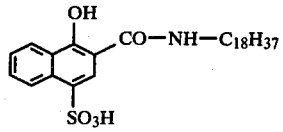

C-7

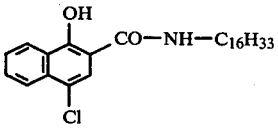

C-8

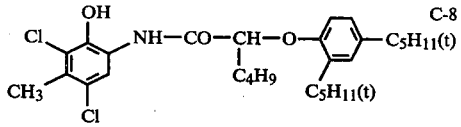

Phenolic cyan couplers couple with color developers D-1 to D-8 according to the present invention to give blue to cyan color; by contrast, naphtholic cyan couplers give brown, orange or red colors in some cases. For example, C-5 couplers to give brown-red, C-7 orange and C-8 cyan.

One feature common to the exemplified color coupler is that they contain groups which make them resistant to diffusion in hydrophilic binder layers. Color couplers of the type in question are generally incorporated in non-diffusing form into a layer of a photographic recording material. The methods used for incorporating them are governed by whether the couplers are hydrophilic or hydrophobic couplers. The corresponding methods are known and need not be explained here. Incorporation into a photographic layer, whether a photosensitive silver halide emulsion layer or an adjacent hydrophilic binder layer, ensures uniform distribution of the color coupler from which an image-wise distribution of azomethine dyes is formed during the chromogenic development of the photosensitive recording material in the presence of the color developer substances according to the present invention. In the process according to the present invention, however, it is also possible in the same way to use soluble color couplers by the so-called "developing-in process". In contrast to the color couplers previously mentioned, the soluble color couplers of this type are not incorporated into the layer, but instead are dissolved in the color developer bath. This process does not require any further explanation either. Since the developer bath penetrates uniformly into the silver halide emulsion layer which has been image-wise exposed a uniform distribution of the color coupler in the layer is initially formed in this case, too, giving an image-wise distribution of azomethine dye during development and oxidative coupling with the colour developer substance in the layer. Accordingly, processing may be carried out in the conventional way, i.e. the recording material which has been image-wise exposed is chromogenically developed in the conventional way in the presence of a color coupler. This may be followed by the conventional photographic processing steps, such as bleaching, fixing and rinsing with water, of which the bleaching and fixing process may optionally be combined into a single process step or, for example where the silver coatings are minimal, may even be left out altogether, a colored image being obtained according to the color coupler and colour developer used.

Another important feature of the process according to the present invention lies in a treatment of the colored image produced after chromogenic development with a solution of a metal salt, during which the corresponding azomethine dye/metal complex is formed. Suitable metal salts are in particular salts of metals of the Ist to IVth Main Groups and of the Ist and IInd and IVth to VIIIth Secondary Groups of the Periodic System of Elements which are known to be suitable as the central atom of organometal complexes. Salts of the following metal ions are particularly preferred according to the present invention: $Ag^{\oplus}$, $Ba^{2+}$, $Ca^{2+}$, $Mg^{2+}$, $Co^{2+}$, $Co^{3+}$, $Cu^{2+}$, $Cr^{3+}$, $Fe^{2+}$, $Fe^{3+}$, $Ni^{2+}$, $Zn^{2+}$, $Cd^{2+}$, $Mn^{2+}$ and $Sr^{2+}$.

During the treatment of the azomethine dyes formed from the described color couplers and the color developers according to the present invention with metal salt solutions, intensive changes in color occur through complex formation, for example from yellow to red, from yellow to black, from yellow to blue. In this connection, the absorption spectra are only negligibly increased in regard to the extinction thereof, but are bathochemically or hypsochromically shifted and widened to a considerable extent in regard to the position of the maxima. Inspite of this, dyes of, in some cases, extreme brilliance are formed. The colors formed are dependent to a large extent on the structure of the coupler used and the metal ion used. The most intensive changes in color occur in the case of yellow dyes. According to the present invention, the metal salts are used in aqueous solution, the concentration of the metal salts being variable within wide limits, for example from 0.001 to 20%, by weight, preferably from 0.1 to 1%, by weight. The complexing time may be from 0.1 to 30 minutes, preferably from 3 seconds to 3 minutes, at pH values of from 2 to 13. In this connection, however, it should be borne in mind that certain buffer solutions contain complex-forming anions (for example citrate and phosphate) which may compete with the azomethine dyes for the metal ion so that secondary changes in color are occasionally observed.

Layers which contain only very low concentrations of dye may be "visually strengthened" by the change in the absorption spectra. By the shift of the absorption maximum brought about by complexing with metal ions, the process according to the present invention affords the possibility of displacing the spectrum of a certain dye barely discernible to the eye into a region of the spectrum in which the eye is more naturally sensitive without at the same time significantly affecting the extinction: For example, a yellow azomethine dye image barely discernible to the eye may be converted into a much better visible blue azomethine dye/metal complex image by utilizing the change in color from yellow to black or from yellow to blue. In addition to a shift in the absorption spectrum, complexing also brings about a distinct improvement in the light stability of the chromogenically-produced azomethine dyes. Stability in storage in a heating cabinet and so-called "tropical cabinet" is also distinctly improved.

By the possibility of obtaining an intensively colored dye image from a silver image by way of chromogenic development, the process according to the present invention opens up advantageous applications. It is possible, for example, to use a monochromatic recording material which gives a metal complex dye image instead of a silver image. At the same time, the silver used may be completely recovered from the recording material by bleaching and fixing. Also, in contast to conventional black-and-white recording materials, DIR-compounds may additionally be used for improving graininess and definition. Accordingly, the process according to the present invention is suitable for the production of storable documents and for microphotography. The process according to the present invention is particularly suitable for X-ray photography because a considerable saving of silver is achieved by the possibility of producing black metal complex dyes having considerably higher stability (compared with dyes formed from the so-called "color couplers" of the m-aminophenol type according to German Offenlegungsschriften Nos. 2,818,363 and 2,644,194).

Using the process according to the present invention, it is also possible to produce multicolored images, for example when multilayer recording materials containing various couplers which, after complexing with the same metal ion, give different complex dyes are used.

Instead of a treatment with the metal salt after the chromogenic development process, it is also possible in certain circumstances directly to add the metal salt to the developer bath or even to incorporate it in suitable form into a layer of the color photographic recording material. In this case, however, it is important to bear in mind that some couplers, but particularly magenta or yellow couplers, are capable of forming metal complexes even before the chromogenic development process so that it is advisable to take suitable measures for preventing premature complexing of the color coupler.

EXAMPLE 1

1 g of yellow coupler Y-10 was dissolved in a mixture of 3 g of ethyl acetate, 1 g of dibutyl phthalate (oil-former) and 0.1 g of sulfosuccinic acid di-n-octyl ester (wetting agent). The resulting solution was emulsified in 100 ml of a 5% gelatin solution, 30 g of a silver chloride bromide emulsion were added to the thus-formed emulsion which was then applied to a paper support coated with polyethylene terephthalate in a quantity sufficient to produce a covering of 1 g of coupler and 0.7 g of silver ($AgNO_3$) per square meter. A layer containing an instant hardener was coated on top of the silver halide layer. The material was exposed and developed for 2 minutes at 23° C. in a developer which had been obtained by dissolving 4 g of developer D-2 in 400 ml of water and adjusting the resulting solution to pH 13.2 using 600 ml of 1 N NaOH. The material was then bleached, fixed and rinsed in the conventional way. Various strips of the thus-obtained layer containing a yellow azomethine dye (max, 460 nm) were immersed for periods of 1 minute in 1% aqueous metal salt solutions, the changes in color indicated in Table 1 below being obtained. The FIGURE shows the absorption spectra of the non-complexed yellow dye (curve 1) and of some of the dye-metal complexes formed.

TABLE 1

| Y-10/D-2 (yellow) complexed with | | | | | | |
|---|---|---|---|---|---|---|
| $CoSO_4$ | $CuSO_4$ | $CdCl_2$ | CuCl | $NiCl_2$ | $MnSO_4$ | $ZnSO_4$ |
| Black (curve 2) | black (curve 3) | red-orange (curve 5) | black | red (curve 4) | orange | orange (curve 6) |

EXAMPLE 2

A number of individual layers with other color couplers is produced and processed in the same way as described in Example 1. The following color changes (Table 2) are observed after treatment with 1% metal salt solutions:

TABLE 2

| | Complexed with | | | | | | |
|---|---|---|---|---|---|---|---|
| Dye | $CdCl_2$ | $AgNO_3$ | $CoCl_2$ | $NiCl_2$ | $CuSO_4$ | $CuCl_2$ | $ZnCl_2$ |
| Y-6/D-2 | red | — | black | black | blue | blue | — |
| M-9/D-2 | — | — | — | blue | — | — | blue |
| M-2/D-2 | — | — | — | blue | green | — | — |
| Y-9/D-2 | orange | — | blue | black | blue | — | red |

EXAMPLE 3

A material produced in accordance with Example 1, except that it contained different coatings of silver ($AgNO_3$), was processed with developer D-1 and then complexed for 1 minute in 1% $CuSO_4$ solution. The results obtained are set out in Table 3 below:

TABLE 3

| Silver coating [mg of $AgNO_3$] | Azomethine dye | Metal complex dye |
|---|---|---|
| 100 | yellow | blue |
| 65 | yellow | blue |
| 35 | yellow | blue |
| 25 | no longer visually discernible | blue (still distinctly visible) |
| 20 | no longer visually discernible | blue (still distinctly visible) |

Accordingly, weak yellow dye densities may subsequently be "visually strengthened" by complexing by the shift of the absorption maximum into a spectral region in which the eye is more naturally sensitive.

EXAMPLE 4

A single-layer material was produced using the color coupler Y-6, exposed and developed in the same way as described in Example 1 for the yellow coupler Y-10.

The thus-produced material was then bathed for 5 minutes in a 1% $CuSO_4$ solution and subsequently rinsed. A deep black layer was formed.

When strips of this material were immersed in pH 2–13 buffer solution, changes in color from yellow to orange were observed. If, by contrast, the strips are immersed in hydrochloric acid or sodium hydroxide solutions of the same pH-value, no changes in color occur.

This shows that the anions (for example citrate) present in the buffer solutions compete with the azomethine dye for the metal ion and that on the other hand, in the absence of similarly complexing anions such as these but over a wide pH-range, stable metal complex azomethine dyes are formed.

EXAMPLE 5

A material produced and processed in the same way as in Example 1 was Xenotested ($4.8 \cdot 10^7$ lux.h) in uncomplexed form (yellow) and after complexing with 1% $CoCl_2$ solution or 1% $CuSO_4$ solution. The following percentage reductions in density were obtained for a density of 1.5:

| azomethine dye | reduction in density [%] measured behind | | |
|---|---|---|---|
| | blue | green | red filter |
| uncomplexed | 15 | | |
| complexed with | | | |
| $CuSO_4$ | 0 | 2 | 3 |
| $CoCl_2$ | 2 | 3 | 4 |

EXAMPLE 6

A conventional photographic X-ray recording material, which additionally contains 1.8 g/m$^2$ of the yellow coupler Y-10, was exposed to X-rays in the conventional way and then developed in a colour developer solution containing 3.0 g/l of D-1 at pH 13.2/23° C.

After bleaching and fixing in the conventional way, the material was briefly treated (10 seconds) with a 3% $CoCl_2$ solution. An X-ray photograph of high contrast and good definition was obtained.

We claim:

1. The process of producing color photographic images consisting of metal complexed azomethine dyes by the chromogenic development of an imagewise exposed color photographic recording material containing at least one silver halide emulsion layer, comprising the steps of (a) oxidizing a color developer compound containing a primary amino group and present in uniform distribution by development of silver halide which has been imagewise exposed;

(b) coupling the oxidized color developer compound with a color coupler present in uniform distribution to produce a dye image consisting of an azomethine dye; and (c) reacting the azomethine dye with a metal salt to form an azomethine dye metal complex in which the color developer compound used corresponds to the general formula

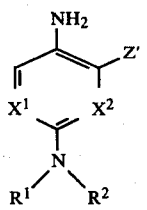

in which $X^1$ and $X^2$ each represents a nitrogen atom or a methine group;

Z' represents a group capable of metal chelate formation;

and $R^1$ and $R^2$ each represents alkyl or $R^1$ or $R^2$ together represent the radical required to complete a cyclic amino group; and the azomethine dye is reacted with a metal salt of a metal of the Ist to VIth Main Group or of the Ist, IInd or IVth to VIIIth Secondary Group of the Periodic System of Elements.

2. The process as claimed in claim 1, in which the color developer compound used corresponds to the following formula:

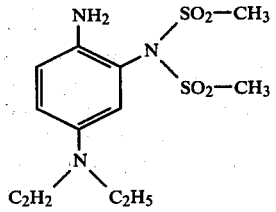

3. The process as claimed in claim 1, in which the color photographic recording material after the chromogenic development (steps (a) and (b)) is treated with an aqueous solution containing a salt of the metal.

* * * * *